US005930579A

United States Patent [19]

Nagumo et al.

[11] Patent Number: 5,930,579

[45] Date of Patent: Jul. 27, 1999

[54] METHOD FOR MANUFACTURING REDUCED IRON BRIQUETTES

[75] Inventors: Hiroshi Nagumo; Yutaka Inada, both of Takasago, Japan; Yoshinori Kanno, Bolivar, Venezuela; Osamu Tsuge, Takasago, Japan

[73] Assignee: Kabushiki Kaisha Kobe Seiko Sho, Kobe, Japan

[21] Appl. No.: 08/549,205

[22] Filed: Oct. 27, 1995

[51] Int. Cl.[6] ..... B22F 3/24; C21D 1/18

[52] U.S. Cl. ..... 419/2; 419/25; 75/765; 148/660

[58] Field of Search ..... 419/25, 2; 75/745, 75/751, 753, 765, 770, 571; 148/660

[56] References Cited

U.S. PATENT DOCUMENTS 4,179,281 12/1979 Ono et al. .
4,236,699 12/1980 Davis, Jr. .

*Primary Examiner*—Daniel J. Jenkins
*Attorney, Agent, or Firm*—Oblon, Spivak, McClelland, Maier & Neustadt, P.C.

[57] ABSTRACT

A method for manufacturing reduced iron briquettes, wherein reduced iron obtained by a direct reduction method is made into briquettes using a briquette machine, and whereafter the hot briquettes are subject to gradual cooling at a cooling rate in the range of 150° C. to 250° C. per minute using water spray. The reduced iron briquettes thus obtained are (a) less prone to breakage break during storage and transport; (b) less prone to degeneration into powder accompanying such breakages etc.; and (c) also display an excellent degree of metallization. Hence, the loss in weight during storage and transport can be reduced, and the harmful effects caused by dust to the transport vehicles, ships, loading/unloading equipment, and operators of the same can be reduced. Also, since the number of breakages is reduced, there is also a reduction in the amount of any re-oxidation of the reduced iron which tends to occur at newly exposed faces, whereby a product of more consistent quality can be obtained.

5 Claims, 4 Drawing Sheets

METHOD FOR MANUFACTURING REDUCED IRON BRIQUETTES

FIELD OF THE INVENTION

This invention relates to reduced iron briquettes to be used as the raw smelting material for a steel-making furnace such as an electric furnace.

DESCRIPTION OF THE RELATED ART

FIG. 7 is a generalized view of equipment for manufacturing reduced iron briquettes. The reduced iron briquettes are generally manufactured in the following manner. Raw material (G), such as pellets, solid iron ore etc. is fed into a furnace (1) from the top thereof, where it is reduced and then discharged from the bottom of the furnace as reduced iron. This reduced iron is then supplied to a briquette machine (2) having caliber rolls and breaker provided in succession. The caliber rolls presses the reduced iron into a plate having cutting grooves at specified intervals. The breaker then cuts this reduced iron plate into pieces, to form reduced iron briquettes B1. These briquettes have a temperature of about 700° C. Next, these hot reduced iron briquettes are fed into a quench tank (3) to be rapidly cooled by the cold water inside the tank (3). The cooled briquettes B2 arm then discharged from the quench tank (3) by conveyor (4).

Although there are cases in which the reduced iron briquettes B2 manufactured in the above-described manner, are transported to a neighboring steel making plant to be immediately smelted in a steel-making furnace, they are more often than not manufactured in a country in which the cost of raw materials and fuel is low, and then exported to the country requiring raw iron material. Accordingly, including the export step, the reduced iron briquettes are transported and stored several times. During such storage and transport, if the strength of the briquette is low, cracks will form and powder may be formed thereby causing a loss in weight. Also, the powder formed creates dust which not only has a bad effect on the environment, but also is not good for the vehicles, ships used to transport the briquettes or for the equipment used to load the briquettes on and off thereof, and is also harmful to those operators working at the loading/unloading site etc.

Furthermore, if the briquette breaks, there is the problem that the reduced iron at the newly exposed face will be re-oxidized, bringing about a reduction in the degree of metallization, and consequent reduction in the quality of the product. In addition, operational problems are brought about such as drops in the smelting yield caused by the breakages, powderisation, and reduction in degree of metallization.

In order to remedy these problems, various improvements have been made with respect to the conditions for manufacturing the briquettes etc., but none of these can be deemed to be entirely satisfactory, and there is still a demand for further technical improvements to remedy the problems of breakage and powder-generation, and accompanying problem of low smelting yield.

This invention was made in the light of the above-described problems, and has as its objective the provision of a method for manufacturing reduced iron briquettes which produces reduced iron briquettes which are less prone to break and degenerate into powder during transport or storage.

SUMMARY OF THE INVENTION

In order to achieve the above object, one embodiment of the method for manufacturing reduced iron briquettes according to the present invention comprises the steps of using a briquette machine to make briquettes out of reduced iron obtained by a direct reduction method; and then using a water spray to gradually cool these hot briquettes at a cooling rate in the range of 150°C.–350° C. per minute.

Another embodiment of the present invention comprises the steps of using a briquette machine to make briquettes out of reduced iron obtained by a direct reduction method; using water spray to gradually cool these hot briquettes to a temperature in the range of 350° C. to 250° C. at a cooling rate in the range of 150° C. to 350° C. per minute; and then rapidly cooling said briquettes using water.

Another embodiment of the present invention comprises the steps of using a briquette machine to make briquettes out of reduced iron obtained by a direct reduction method; using a gas to gradually cool these hot briquettes to a temperature in the range of 350° C. to 250° C. at a cooling rate in the range of 150° C. to 350° C. per minute; and then rapidly cooling said briquettes using water.

Another embodiment of the present invention comprises the steps of using a briquette machine to make briquettes out of reduced iron obtained by a direct reduction method; using inert gas to gradually cool said hot briquettes to a temperature in the range of 620° C. to 550° C. at a cooling rate in the range of 150° C. to 350° C. per minute; subsequently using water spray to further gradually cool the briquettes to a temperature in the range of 350° C. to 250° C. at a cooling rate in the range of 150° C. to 350° C. per minute; and then using water to rapidly cool said briquettes.

Hereunder, the present invention, and its effect shall be described in more detail.

A thorough investigation by the inventors of the present invention of the causes of cracks in reduced iron briquettes manufactured using the conventional method described earlier, revealed that when hot reduced iron briquettes are rapidly cooled by feeding them into a water tank, internal stress remains within the briquette, and minute cracks are generated inside the briquette, thereby making the briquette prone to breakage even when only slightly impacted.

If gradual cooling is employed to try and remedy the above, reduced iron briquettes which are relatively resistant to breakage can be obtained, but there results a decrease in productivity due to the increase in cooling time, and if the hot briquettes are cooled in air to room temperature, the reduced iron becomes re-oxidized with a consequent reduction in the degree of metallization.

With the method of the present invention, the hot briquettes are gradually cooled using water spray, or are first subjected to gradual cooling using gas or water spray and then subsequently subjected to rapid cooling using water. A reduction in the surface temperature of the briquette at a rate in the range of 150° C. to 350° C. per minute is preferred. If the cooling rate is made any faster than this, the properties of the briquette do not differ significantly from a briquette cooled rapidly in water, and the briquette is of low strength and is prone to breakage. On the other hand, if the cooling rate is even slower than this preferred range, the briquette does not differ significantly from a briquette left to cool in air, and the reduced iron suffers re-oxidation with a consequent reduction in the degree of metallization. There is also the problem that a long time is required for cooling causing a decrease in productivity.

In the case that the briquette is fast subject to gradual cooling using gas or spray water, and then subsequently subjected to rapid cooling using water, it is preferred that gradual cooling be performed to a temperature in the range of 350° C. to 250° C. If the gradual cooling is stopped at a temperature higher than 350° C. and then rapid cooling is performed, then the briquette produced is not so different from a briquette which has been rapidly cooled right from the start. If gradual cooling is continued to a temperature lower than 250° C. then the time required for cooling (which will of course depend on the cooling rate) is lengthened with consequent problems with respect to productivity. If air is used as the gas to effect the gradual cooling, the reduced iron suffers re-oxidation with a consequent reduction in the degree of metallization. Accordingly, it is preferred that an inert gas be used, but an air-inert gas mixture in which inert gas is included to at least 20% may also be used.

In the case that the briquette is first subjected to gradual cooling using an inert gas followed by gradual cooling using water spray and is then subsequently subjected to rapid cooling using water, the gradual cooling by gas should be performed to a temperature in the range of 620° C. to 550° C. and the gradual cooling by water spray should be performed to a temperature in the range of 350° C. to 250° C. If the initial gradual cooling is performed using an inert gas, then even if the briquette is then subject to subsequent cooling using water spray or water, re-oxidation of the reduced iron can be suppressed. If combined with subsequent cooling using water spray, a reduced iron briquette having high strength and high resistance to breakage can be obtained. However, if the above stated temperature range is exceeded, there will be a reduction in the degree of this effect. The reason for using spray water is that the gradual cooling can be even more easily controlled than in the case of only using gas.

DETAILED DESCRIPTION OF THE EMBODIMENTS

Hereunder embodiments of the present invention shall be explained.

Figure 1:
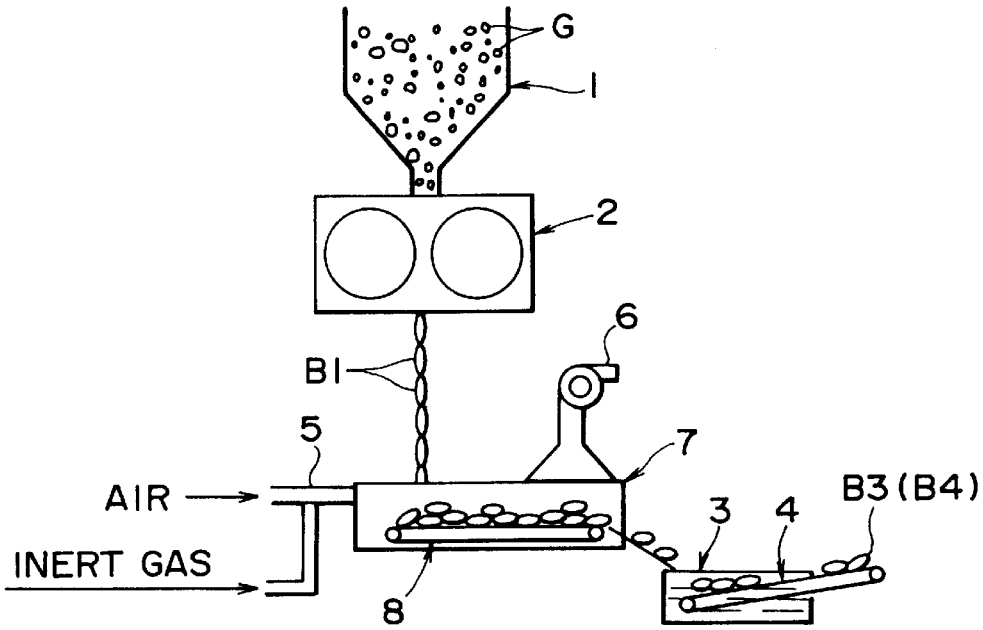
FIG. 1 is a generalized view of equipment used to apply the method of manufacturing a reduced iron briquette according to the present invention.

FIG. 1 is a generalized view of equipment used to apply the method of manufacturing a reduced iron briquette according to the present invention. Reduction furnace (1) and briquette machine (2) have the same construction as those used in the prior art. Raw material (G) such as solid iron ore, pellets etc. is reduced inside the reduction furnace (1) and discharged from the bottom thereof as reduced iron. A briquette machine (2) is provided connected to the reduction furnace (1), and is used to make reduced iron briquettes B1 from the reduced iron discharged from the bottom of the reduction furnace.

The reduced iron briquette B1 directly after being formed in the way described above has a temperature of about 700° C. In this embodiment, the briquettes B1 were fed on a conveyor (8) into the inside of an annular cooler (7), which has apparatus for introducing air (5) and air exhaust apparatus (6), and is gradually cooled to 300° C. by a gas mixture of air and inert gas. The temperature of the reduced iron briquette was decreased by 160° C. during the first minute, 170° C. during the second minute, and 80° C. during the remaining 20 seconds or so. Thereafter, the briquettes were fed into a quench tank (3) as in the prior an method, and rapidly cooled by the water inside the quench tank (3). The cooled reduced iron briquettes B3 were then discharged from quench tank (3) by conveyor (4).

Tests to measure strength and degree of metallization were performed on (i) reduced iron briquettes B3 made in the way described above; (ii) reduced iron briquettes B4 which have been subjected to gradual cooling in air to a temperature of 200° C. and then subsequently subjected to rapid cooling using water; and (iii) reduced iron briquettes B2 subjected only to rapid cooling in water in accordance with the prior art method.

Strength was measured using a drop test, which comprises loading an appropriate number of reduced iron briquettes into a steel box, and then dropping said steel box five times from a height of 10 m. Then, the contents of the box are passed through sieves of various dimensions, as listed along the x-axis of the graph of FIG. 2, to effect particle size analysis and thereby assess how prone the briquette is to breakage and how prone it is to crumble into powder.

Figure 2:
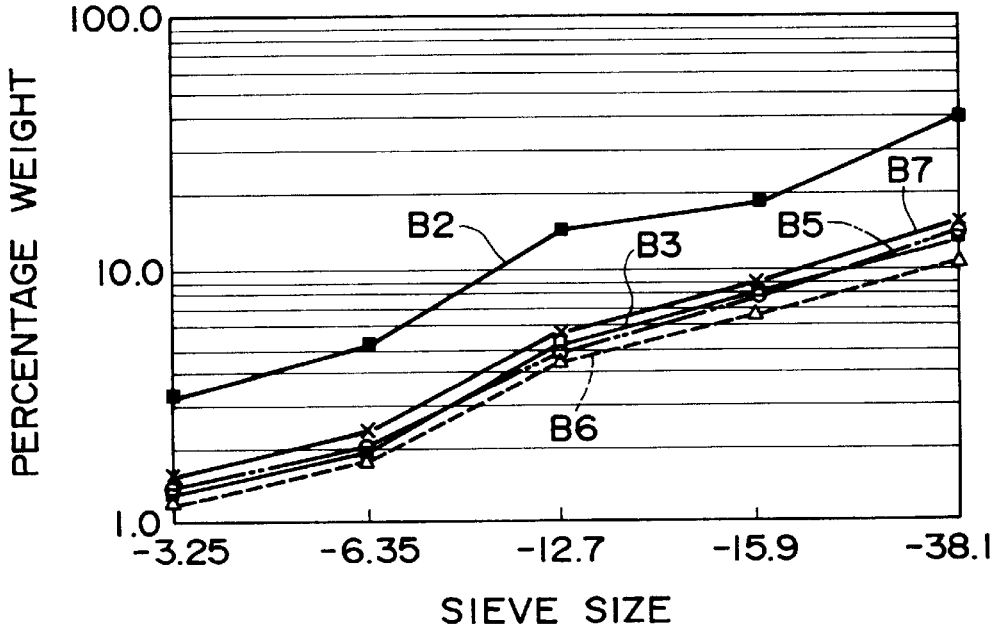
FIG. 2 is a graph comparing the results of a drop test applied to a briquette made by the conventional method and to a briquette made by the method according to the present invention.
Figure 3:
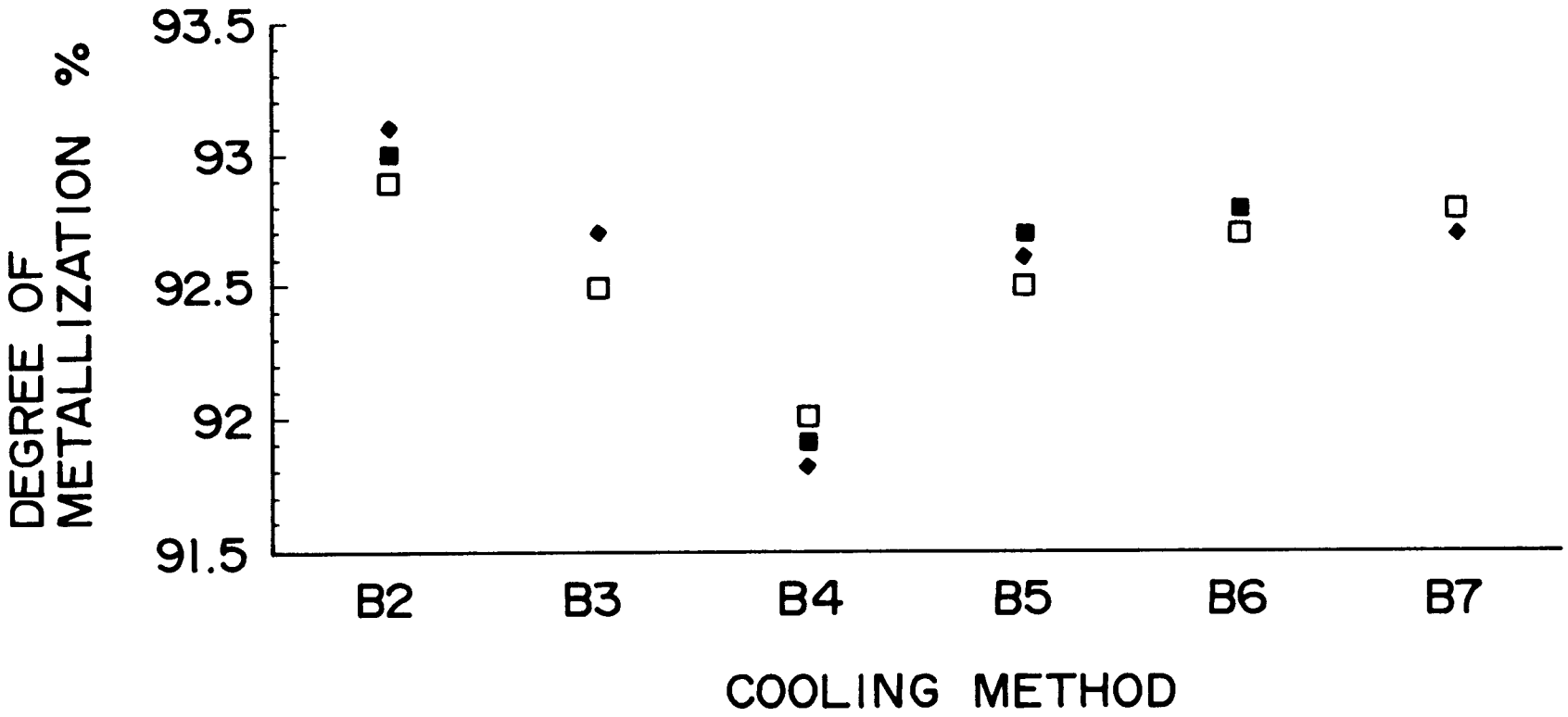
FIG. 3 is a graph comparing the degree of metallization measured for a briquette made by the conventional method and for a briquette made by the method according to the present invention.

The results of the strength test are as shown in FIG. 2. The amount of solid material having a particle size equal to or grater than 38.1 mm was 88% in the case of the reduced iron briquettes B3 made by the method according to the present invention, compared to 60% for the reduced iron briquettes B2 made according to the conventional method. The results for reduced iron briquettes B4, which were made by a comparable method to reduced iron briquettes B3, are omitted from the graph, but were in fact almost no different from the results obtained for reduced iron briquette B3. Also, the amount of powder generated having a size equal to or less than 6.35 mm was 2% in the case of reduced iron briquettes B3 made by the method of the present invention, compared to 5% in the case of the reduced iron briquettes B2 made by the conventional method. The results of the test to measure the degree of metallization are shown in FIG. 3. As is clear from FIG. 3, although a slight drop (no more than 0.5%) in degree of metallization was seen for the briquettes B3 made by the present invention compared to the briquettes B2 made by the conventional method, nevertheless the absolute value for the degree of metallization obtained is still high. In comparison, the briquettes B4 made by a comparative method, show a relatively large drop (about 1%) in degree of metallization compared to the reduced iron briquettes B2 made by the conventional method. We can see from these results that, the reduced iron briquettes B3 made according to the present invention are less prone to breakage and less prone to degenerate into powder than reduced iron briquettes B2 made by the conventional method, and also do not display that much of a reduction in degree of metallization compared to the briquettes made by the conventional method.

Embodiments 2

Figure 4:
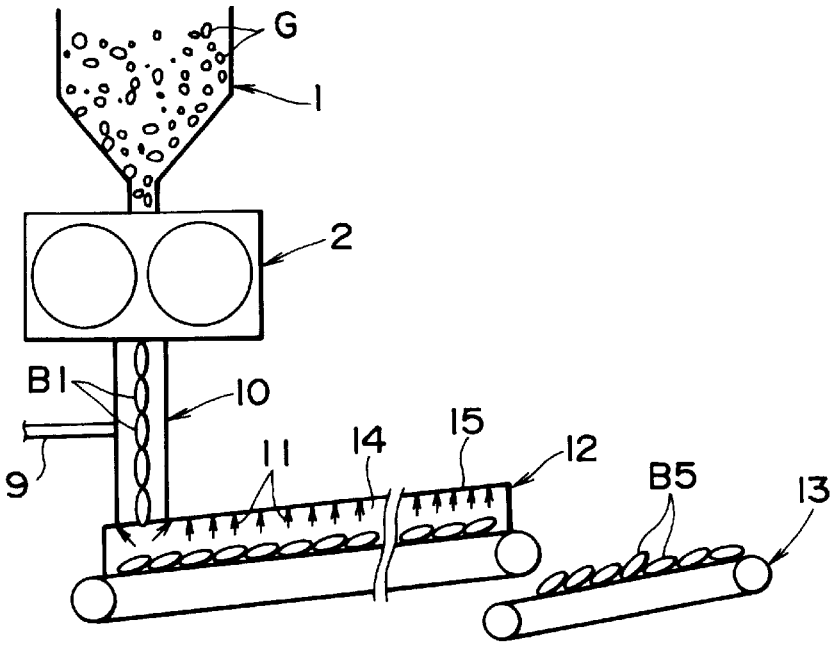
FIG. 4 is a generalized view of another example of equipment used to apply the method of manufacturing a reduced iron briquette according to the present invention.

FIG. 4 shows a generalized view of equipment used to apply the method of manufacturing reduced iron briquettes according to the present invention. Reduction furnace (1) and briquette machine (2) have the same construction as those used in the prior art. Reduced iron discharged from the bottom of reduction furnace (1) is formed into hot reduced iron briquettes (B1) in the same manner as described for the first embodiment.

The reduced iron briquette B1 directly after being formed in the way described above has a temperature of about 700° C. In this embodiment, the reduced iron briquette B1 was dropped through a cooling chute (10), which is connected to the briquette machine (2) and provided with pipe (9) for supplying inert gas to the inside thereof, to thus deliver it to a spray cooling conveyor (12), which has spray nozzles (11) provided in the upper part of the inside thereof. The briquette is subsequently delivered onto conveyor (13). During their passage through the above-described equipment, the reduced iron briquettes are first gradually cooled for about 30 seconds inside cooling chute (10) to a temperature of about 600° C., and then subsequently cooled over a period of about 1.5 minutes inside the first half of spray cooling conveyor (12) to a temperature of about 300° C. by controlling the amount of water spray delivered by nozzles (11). Then they are subject to rapid cooling inside the second half of spray cooler type conveyor by increasing the amount of water delivered to nozzles (11), to produce a completely cooled reduced iron briquette B5.

The briquette B5 obtained in the above-described manner was then tested in the same way as in embodiment 1 to measure strength and degree of metallization. The results of the strength test are also shown in FIG. 2, and are almost the same as the results obtained for the reduced iron briquettes B3 of the first embodiment. The degree of metallization measured is shown in FIG. 3. As is clear from FIG. 3, and as was the case for reduced iron briquettes B3 of the first embodiment, a slight reduction in the degree of metallization (no more than 0.5%) is observed for reduced iron briquettes B5 compared to the briquettes B2 made by the conventional method, but nevertheless a high absolute degree of metallization is still obtained. Accordingly, it can be seen that the reduced iron briquettes B5 made by the method of this embodiment are also less prone to breakage and less prone to degenerate into powder, than reduced iron briquettes B2 made by the conventional method, and also do not display that much of a large reduction in degree of metallization compared to the reduced iron briquettes B2 made by the conventional method.

Embodiment 3

Figure 5:
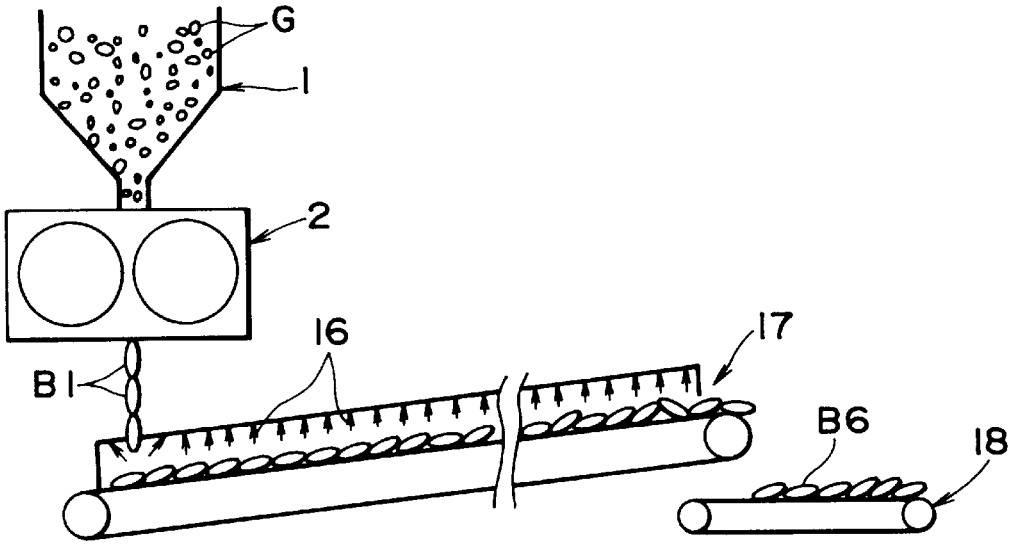
FIG. 5 is a generalized view of another example of equipment used to apply the method of manufacturing a reduced iron briquette according to the present invention.

FIG. 5 is a generalized view of equipment used to apply the method of manufacturing reduced iron briquettes according to the present invention. Reduction furnace (1) and briquette machine (2) have the same construction as those use in the prior art. Reduced iron discharged from the bottom of reduction furnace (1) is formed into hot reduced iron briquettes (B1) in the same manner as described for the first embodiment.

The reduced iron briquette B1 directly after being formed in the way described above has a temperature of about 700° C. In this embodiment, the briquette is delivered to a spray cooler type-conveyor 17, which is provided connected to the briquette machine (2) and has spray nozzles (16) provided towards the top of the inside thereof, and then delivered to a conveyor (18). During it's passage through the spray cooler type conveyor (17), the amount of spray discharged from the nozzles is controlled to gradually cool the briquettes over a period of about 3 minutes to about 70° C., to produce cooled reduced iron briquettes, B6.

The briquette B6 obtained in the above-described manner was then tested in the same way as in embodiment 1 to measure speedy and degree of metallization. The results of the strength test are also shown in FIG. 2, and are almost the same as the results obtained for the reduced iron briquettes B3 of the first embodiment. The degree of metallization measured is shown in FIG. 3. As is clear from FIG. 3, and as was the case for reduced iron briquettes B3 of the first embodiment, a slight reduction in the degree of metallization (no more than 0.5%) is observed for reduced iron briquettes B6 compared to the briquettes B2 made by the conventional method, but nevertheless a high absolute degree of metallization is obtained. Accordingly, it can be seen that the reduced iron briquettes B6 made by the method of this embodiment are less prone to breakage and less prone to degenerate into powder, than reduced iron briquettes B2 made by the conventional method, and also do not display that much of a large reduction in degree of metallization compared to the reduced iron briquettes B2 made by the conventional method.

Embodiment 4

Figure 6:
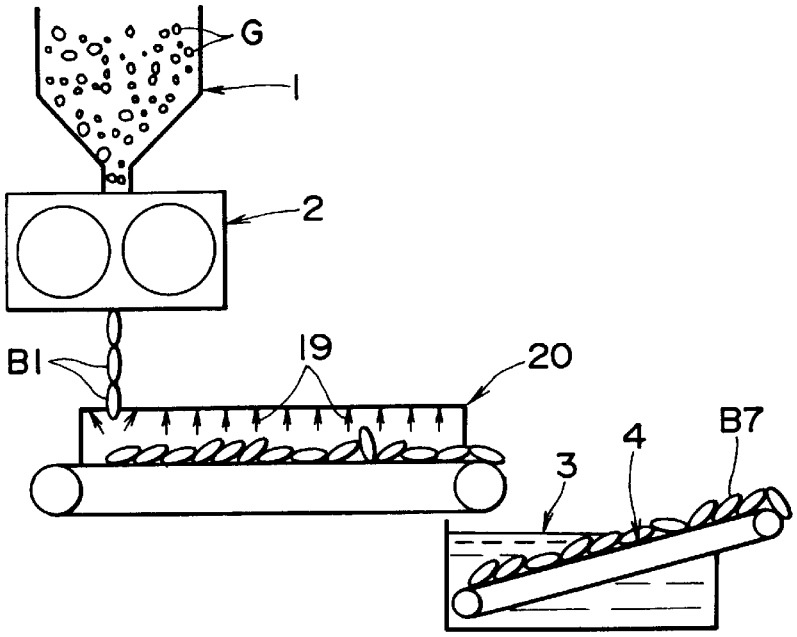
FIG. 6 is a generalized view of another example of equipment used to apply the method of manufacturing a reduced iron briquette according to the present invention.
Figure 7:
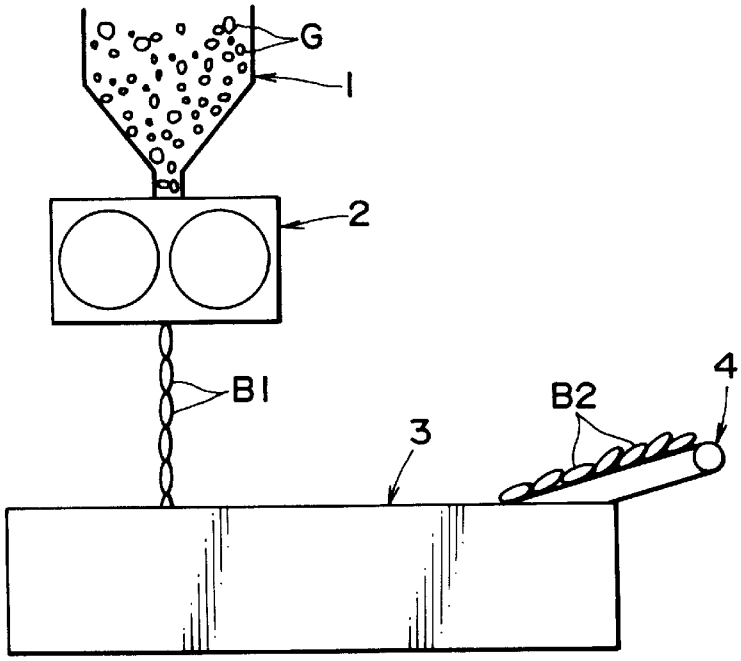
FIG. 7 PRIOR ART
FIG. 7 is a generalized view of equipment used conventionally to manufacture reduced iron briquettes.

FIG. 6 is a generalized view of equipment used to apply the method of manufacturing reduced iron briquettes according to the present invention. Reduction furnace (1) and briquette machine (2) have the same construction as those used in the prior art. Reduced iron discharged from the bottom of reduction furnace (1) is formed into hot reduced iron briquettes (B1) in the same manner as described for the first embodiment.

The reduced iron briquette B1 directly after being formed in the way described above has a temperature of about 700° C. In this embodiment, the briquette is fed to a spray cooler type-conveyor 17, which is provided connected to the briquette machine (2) and has spray nozzles (19) provided inside thereof at the top. The amount of spray discharged from nozzles (19) is controlled to gradually cool the briquettes to a temperature of 340° C. over a period of about 1.5 minutes. Then, the briquettes are then fed into a quench tank (30) where they are rapidly cooled by the water inside the quench tank, just as in the conventional method. The cooled briquettes B7 are then discharged from the tank (3) by conveyor (4).

The reduced iron briquette B7 obtained in the above-described manner was then tested in the same way as in embodiment 1 to measure strength and degree of metallization. The results of the strength test are also shown in FIG. 2, and are almost the same as the results obtained for the reduced iron briquettes B3 of the fist embodiment. The degree of metallization measured is shown in FIG. 3. As is clear from FIG. 3, and as was the case for reduced iron briquettes B3 of the first embodiment, a slight reduction in the degree of metallization (no more than 0.5%) is observed for reduced iron briquettes B7 compared to the briquettes B2 made by the conventional method, but nevertheless a high absolute degree of metallization is obtained. Accordingly, it can be seen that the reduced iron briquettes B7 made by the method of this embodiment are also less prone to breakage and less prone to degenerate into powder, than reduced iron briquettes B2 made by the conventional method, and also do not display that much of a large reduction in degree of metallization compared to the reduced iron briquettes B2 made by the conventional method. Furthermore, this embodiment is better than the above-described embodiments in terms of productivity, and is also an economical method in view of the kind of equipment required.

As explained above, according to the briquette manufacturing method of the present invention, it is possible to manufacture reduced iron briquettes which seldom break during storage and transport, and for which the amount of powderisation accompanying such breakages etc. is reduced, and which also display an excellent degree of metallization. Hence, the loss in weight during storage and transport can be reduced, and the harmful effects caused by dust to the transport vehicles, ships, loading/unloading equipment, and operators of the same can be reduced. Also, since the number of breakages is reduced, there is also a reduction in the amount of re-oxidation of the reduced iron which tends to occur at newly exposed faces, whereby a product of more consistent quality can be obtained.

What is claimed is:

1. A method of manufacturing reduced iron briquettes characterized by the steps of:

making briquettes out of reduced iron, obtained by a direct reduction method, using a briquette machine; and gradually cooling the hot briquettes at a cooling rate in the range of 150° C. to 350° C. per minute using water spray.

2. The method of manufacturing reduced iron briquettes according to claim 1 wherein said gradual cooling is performed to a temperature in the range of 350° C. to 250° C. and whereafter said briquettes are subject to rapid cooling using water.

3. The method of claim 1 including the subsequent step of rapidly cooling the briquettes using water.

4. A method of manufacturing reduced iron briquettes characterized by the steps of:

making briquettes out of reduced iron, obtained by a direct reduction method, using a briquette machine;

gradually cooling the hot briquettes to a temperature in the range of 350° C. to 250° C. at a cooling rate in the range of 150° C. to 350° C. per minute using a gas; and then rapidly cooling the briquettes using water.

5. A method of manufacturing reduced iron briquettes characterized by the steps of:

making briquettes out of reduced iron, obtained by a direct reduction method, using a briquette machine;

gradually cooling the hot briquettes to a temperature in the range of 620° C. to 550° C. using an inert gas;

then gradually cooling the briquettes to a temperature in the range of 350° C. to 250° C. at a cooling rate of 150° C. to 350° C. per minute using water spray; and then rapidly cooling the briquettes using water.

* * * * *